US007082688B2

(12) United States Patent
Votolato

(10) Patent No.: US 7,082,688 B2
(45) Date of Patent: Aug. 1, 2006

(54) UTILITY KNIFE WITH DUAL RETRACTABLE CUTTING GUIDES

(75) Inventor: Earl J. Votolato, 2908 Cliff Dr., Newport Beach, CA (US) 92663

(73) Assignees: Earl J. Votolato, Newport Beach, CA (US); Kimberly Votolato, Newport Beach, CA (US); Trustees of the Votolato Trust, Newport Beach, CA (US)

( * ) Notice: Subject to any disclaimer, the term of this patent is extended or adjusted under 35 U.S.C. 154(b) by 15 days.

(21) Appl. No.: 10/958,908

(22) Filed: Oct. 4, 2004

(65) Prior Publication Data

US 2005/0086812 A1 Apr. 28, 2005

Related U.S. Application Data

(60) Provisional application No. 60/515,486, filed on Oct. 28, 2003.

(51) Int. Cl.
*B26B 29/02* (2006.01)
*B26B 3/00* (2006.01)

(52) U.S. Cl. ..... 30/293; 30/2; 30/289; 30/294

(58) Field of Classification Search ..... 30/2, 30/286, 289, 293, 294, 283, 284, 285, 287, 30/288

See application file for complete search history.

(56) References Cited

U.S. PATENT DOCUMENTS 2,068,020 A * 1/1937 Grounds ..... 30/2
2,095,164 A * 10/1937 Babb ..... 30/2
2,247,290 A * 6/1941 Disbrow ..... 30/2
2,248,694 A * 7/1941 Boyette ..... 30/373
2,582,677 A * 1/1952 Burnett ..... 30/2
2,743,523 A * 5/1956 Honey ..... 30/286
3,431,645 A * 3/1969 Powell ..... 30/90.6
4,106,196 A * 8/1978 Smithline ..... 30/294
4,442,595 A 4/1984 Sharrow et al.
4,675,996 A * 6/1987 DuBuque ..... 30/2
4,713,885 A 12/1987 Keklak et al.
4,744,146 A 5/1988 Schmidt
5,333,381 A * 8/1994 Gelardi et al. ..... 30/2
5,522,135 A 6/1996 Votolato
5,545,172 A * 8/1996 Knepshield et al. ..... 606/166
5,575,070 A 11/1996 Anderson
5,697,157 A 12/1997 Votolato
6,070,326 A * 6/2000 Berns ..... 30/2
6,178,640 B1 1/2001 Votolato
6,453,559 B1 * 9/2002 Marshall et al. ..... 30/2
6,560,873 B1 * 5/2003 Ortner et al. ..... 30/2
6,615,495 B1 * 9/2003 Evens et al. ..... 30/289
2002/0124412 A1 9/2002 Votolato
2002/0124418 A1 9/2002 Votolato
2004/0093734 A1 5/2004 Votolato

* cited by examiner

*Primary Examiner*—Hwei-Siu Payer
(74) *Attorney, Agent, or Firm*—Rutan & Tucker, LLP

(57) ABSTRACT

A utility knife includes both left and right side cutting guides. The guides are preferably retractable, and lockable in either retracted or operating positions. The distance between the guides and the blade of the knife can be either fixed or adjustable. The knife preferably also includes a retractable hood that covers the blade.

13 Claims, 4 Drawing Sheets

FIG. 1C
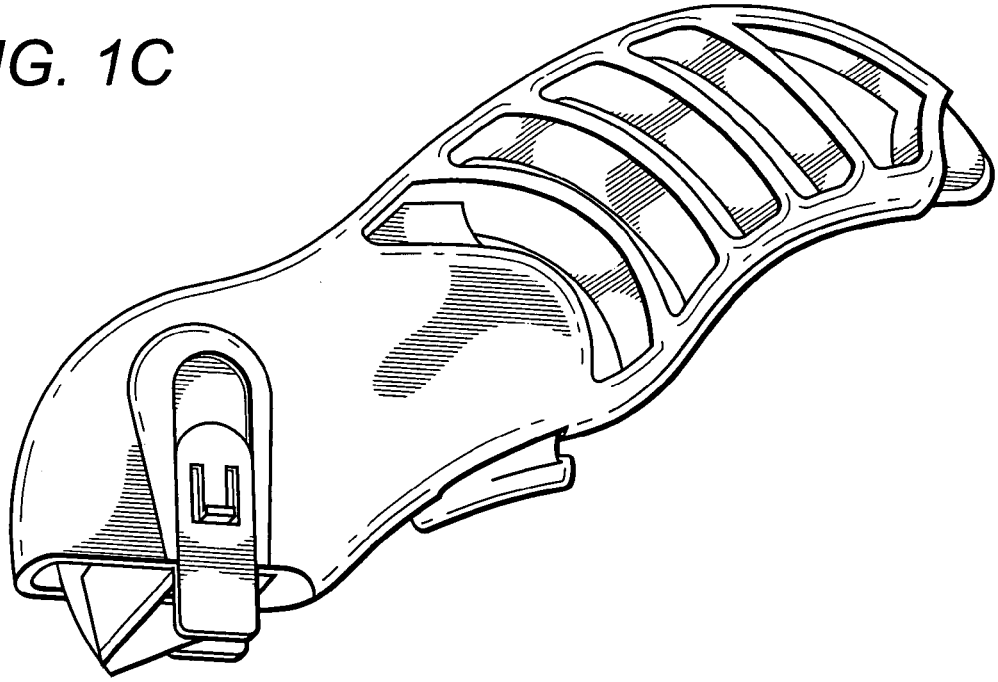
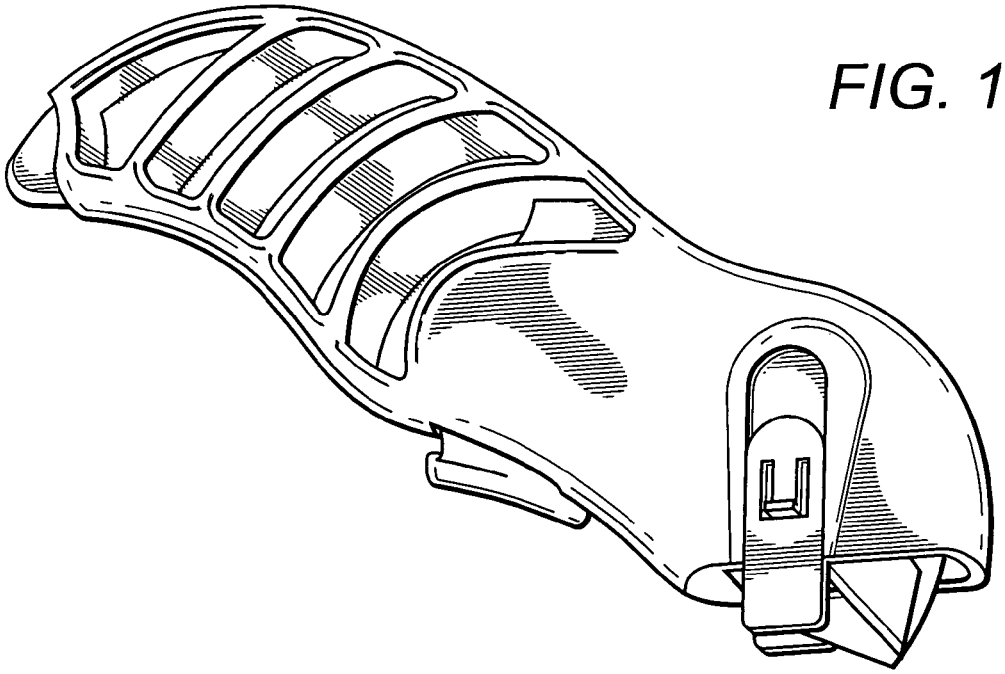
FIG. 1D

FIG. 2A
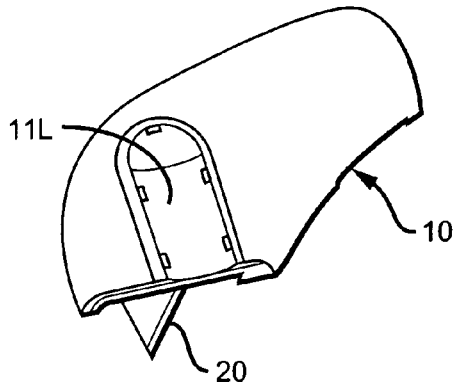
FIG. 2B
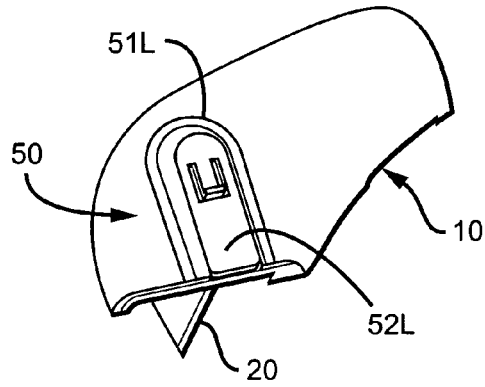
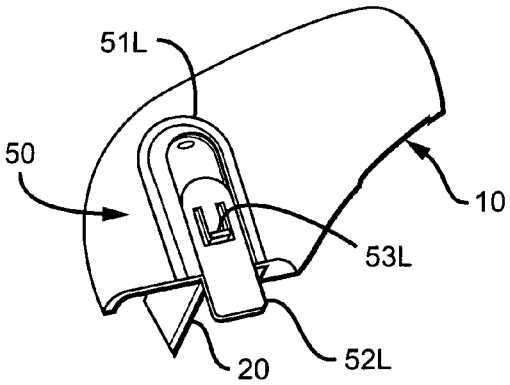
FIG. 2C
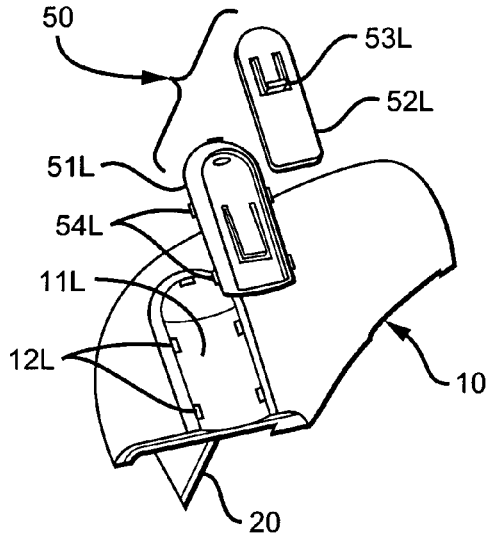
FIG. 2D
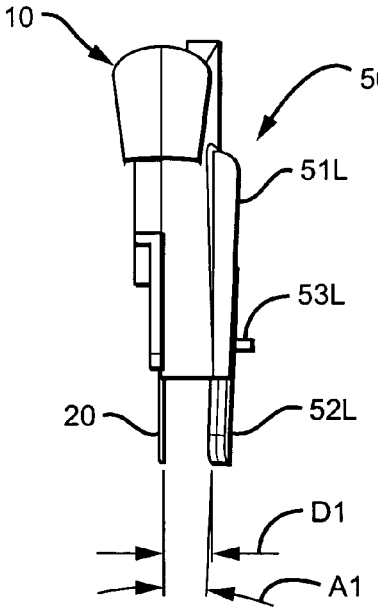
FIG. 2E

UTILITY KNIFE WITH DUAL RETRACTABLE CUTTING GUIDES

This application claims the benefit of U.S. provisional application No. 60/515,486 filed on Oct. 28, 2003, incorporated herein by reference in its entirety.

FIELD OF THE INVENTION

The field of the invention is cutting tools, particularly utility knives.

BACKGROUND

Knives are often used to cut a line along an edge of a workpiece, and it is known in such circumstances to dispose an outrigger-type cutting guide that extends laterally from the knife. U.S. Pat. No. 5,575,070 to Fiskars (November 1996), for example, teaches a cutting implement having a handle with a forward extending blade and a laterally extending guide. The distance between the guide and the blade can be adjusted with a knob carried on the top of the handle. U.S. Pat. No. 4,744,146 to Schmidt (May 1988) teaches a utility knife having a handle having a retractable blade, and a planar guide extending laterally from handle by a controlled distance. U.S. Pat. No. 4,442,595 to Sharrow et al. (April 1984) teaches a laterally spaced guide that is adapted to receive the blade of a utility knife. U.S. Pat. No. 4,713,885 to Keklak et al. (December 1987) teaches a utility knife with a blade guide that descends from the handle.

Each of the cited prior art documents provides a mechanism for controlling the path of a cut of the blade parallel to a side edge of an object being cut. Sometimes the guide is disposed to the left of the blade (as viewed from the user's perspective), and sometimes the guide is disposed to the right of the blade. But in each case there is only one guide, and that guide operates to distance blade only from a right edge or only from a left edge. That limitation reduces the utility of the knife with respect to specific applications that require the opposite orientation.

What is needed is a knife having both a right edge guide and a left edge guide.

SUMMARY OF THE INVENTION

The present invention is directed to providing tools, particularly cutting tools, with symmetrical cutting or other guides to provide for continued guidance of such tools even if the orientation of the tool is changed. Typically only a subset of the guides will be used for a particular orientation, so preferred embodiments will comprise guides adapted to not interfere with use of the tool when such guides are not in use. In some embodiments the guides will be integral with a body of the tool and, when not in use, will be retractable into or adjacent to the body of the tool.

In a preferred embodiment a knife is provided with dual retractable cutting guides such that the knife, with the cutting guides, has left and right sides that are reflections of each other. Such a knife can be used with its guides regardless of whether the knife is held in the left or right hand, and regardless of the direction the knife is moved to cut along a line or curve. Inclusion of the cutting guides facilitates making a cut in parallel with an edge. As an example, one could remove one side of a six sided, cube shaped, cardboard shipping container by cutting each of the four sides coupled to the side being removed along a line parallel to the corner/seam between the side being cut and the side being removed. Removal of the side is facilitated by using a knife having dual retractable cutting guides as one can grasp the knife in a preferred hand, orient it in preparation for cutting along a corner/seam, extend whichever guide is closest to the corner/seam (and, if necessary, retract the opposite guide), place the guide against the corner/seam, and draw the knife along the corner/seam to make a cut in parallel with the corner/seam. When making subsequent cuts, the orientation of the knife can be changed, possibly by switching it between left and right hands, and retracting and/or extending guides as needed. The ability to use the knife in either the left or right hand and still take advantage of the guide makes the a single knife suitable for use by both left and right handed people.

It is contemplated that symmetrical guides can be added to most cutting tools. Examples of knives and other cutting tools having features that may be combined with those disclosed herein include but are not limited to those described in U.S. Pat. No. 6,178,640 titled "Slitter Device", U.S. Pat. No. 5,697,157 titled "Heavy Duty Box Opener", U.S. Pat. No. 5,522,135 titled "Box Opener", U.S. patent application Ser. No. 09/832,214 titled "Utility Knife Tool with Cover Lock", U.S. patent application Ser. No. 09/804,451 titled "Utility Knife Tool", and U.S. patent application Ser. No. 10/300,382 titled "Safety Cutting Apparatus". Each of these patents and patent applications is hereby incorporated by reference in its entirety.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1C is the view of FIG. 1A with surface shading.

FIG. 1D is the view of FIG. 1B with surface shading.

FIG. 2A is a detail view of the front portion of the left side of the knife of FIG. 1A with the guide assembly removed.

FIG. 2B is a detail view of the front portion of the left side of the knife of FIG. 1A with the guide assembly installed and in a retracted position.

FIG. 2C is a detail view of the front portion of the left side of the knife of FIG. 1A with the guide assembly installed and in an extended position.

FIG. 2D is an exploded view of the guide assembly of FIGS. 2B, and 2C.

FIG. 2E is a detailed view of the guide position relative to the blade.

DETAILED DESCRIPTION

Figure 1A:
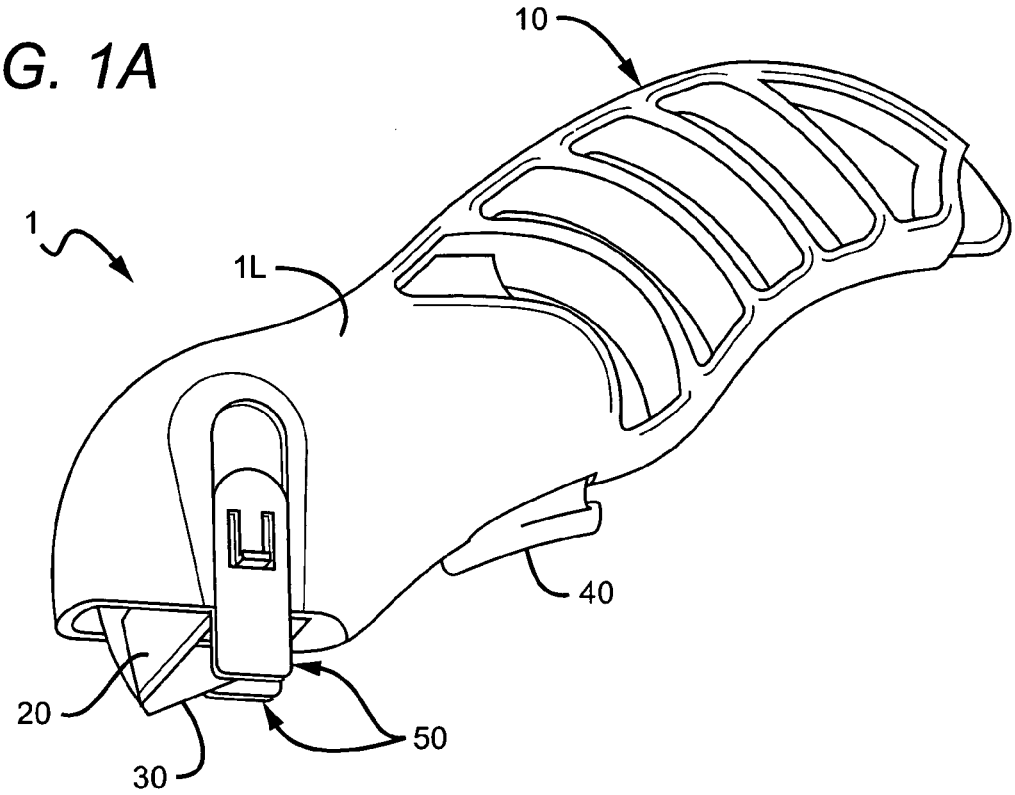
FIG. 1A is a perspective left side view of a knife embodying the invention.
Figure 1B:
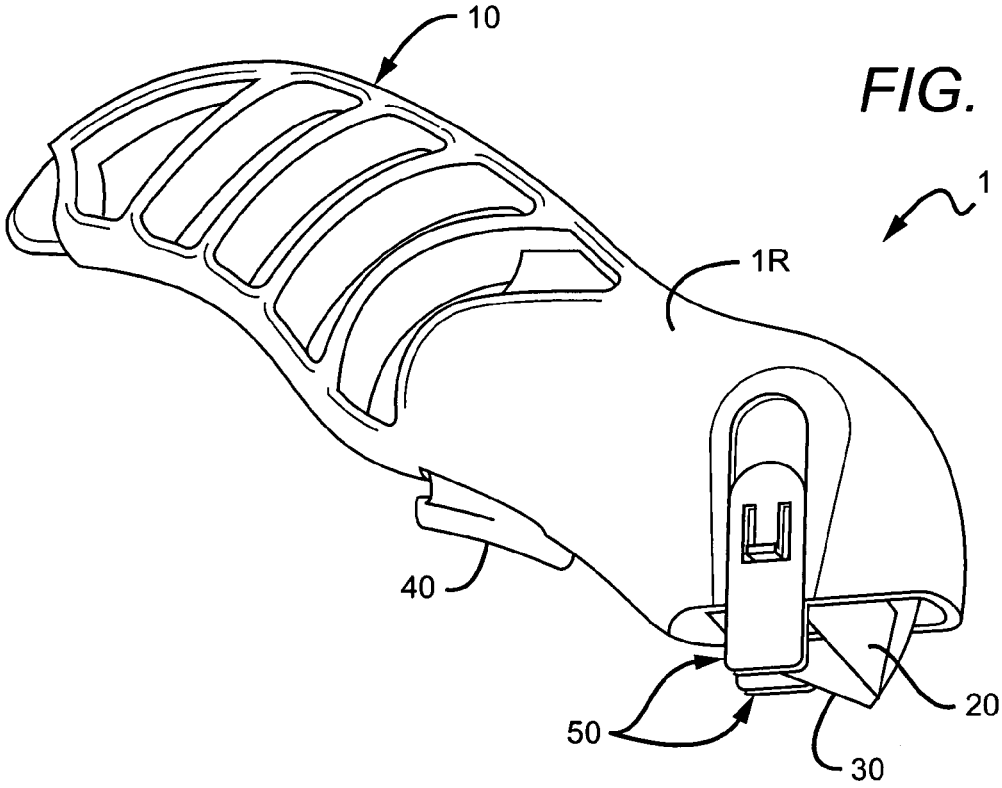
FIG. 1B is a perspective right side view of the knife of FIG. 1A.

FIGS. 1A–1D depict a preferred embodiment of a cutting tool. As shown, a utility knife 1 comprises a body 10, blade 20, blade hood 30, hood release trigger 40, and cutting guide assemblies 50. The external features of knife 1 are symmetrical across a plane dividing the knife into left (1L) and right (1R) sides such that the left and right sides are, at least in regard to primary functional features, mirror images of each other. In particular, knife 1 comprises two equivalent guide assemblies 50 with one assembly on either side of knife 1.

As shown best in FIGS. 2A–2D, guide assemblies 50 each comprise a mounting frame (51L or 51R) positioned in a guide receiving cavity (11L or 11R) of body 10, and an extendable guide (52L or 52R) positioned in the mounting frame (51L or 51R). Each operable combination of mounting frame, cavity and guide comprises an exemplary guide adaptation.

Guides 52L and 52R are adapted to be extended (see FIG. 2C) or retracted (see FIG. 2B), and to be locked into place when extended or retracted via locking mechanism 53L or 53R. Locking mechanisms 53L and 53R are also adapted to facilitate extending or retracting guides 52L and 52R. Either guide 52L or 52R can be retracted by depressing a portion of mechanism 53L or 53R and while keeping that portion depressed, sliding guide 52L or 52R into its retracted position. Guides 52L and 52R can be extended by using the same portion of mechanism 53L or 53R to push (or pull) guide 52L or 52R into its extended position. Frame 51L is preferably plastic and sonically welded into cavity 11L of body 10, and frame 51R into cavity 11R. Cavity 11L may comprise one or more indentations 12L adapted to receive protrusions 54L on frame 51L to facilitate frame 51L being retained in cavity 11L. Similar indentations and protrusions may be included on cavity 11R and frame 51R.

It should be noted that in some instances features shown in FIGS. 2A–2D that have corresponding, similarly numbered features found on the right side of knife 1 may not actually be shown in FIGS. 2A–2E as they are mirror images of those shown for the left side of knife 1.

As best shown in FIG. 2E, one or both guides 52L and 52R are preferably separated from blade 20 by a distance of less than 0.5 inches, more preferably less than 0.25 inches, and most preferably 0.223 inches. Similarly, one or both guides may be parallel the blade but are preferable angled inwardly towards the bottom cutting surface of the blade at an angle of less than 10°, more preferably less than 6°, and most preferably about 4°. In alternative embodiments, the distance from which the guides are separated from their respective sides of the blade, and the relative angles, may be larger or smaller than that described above, or may be user adjustable.

Figure 3A:
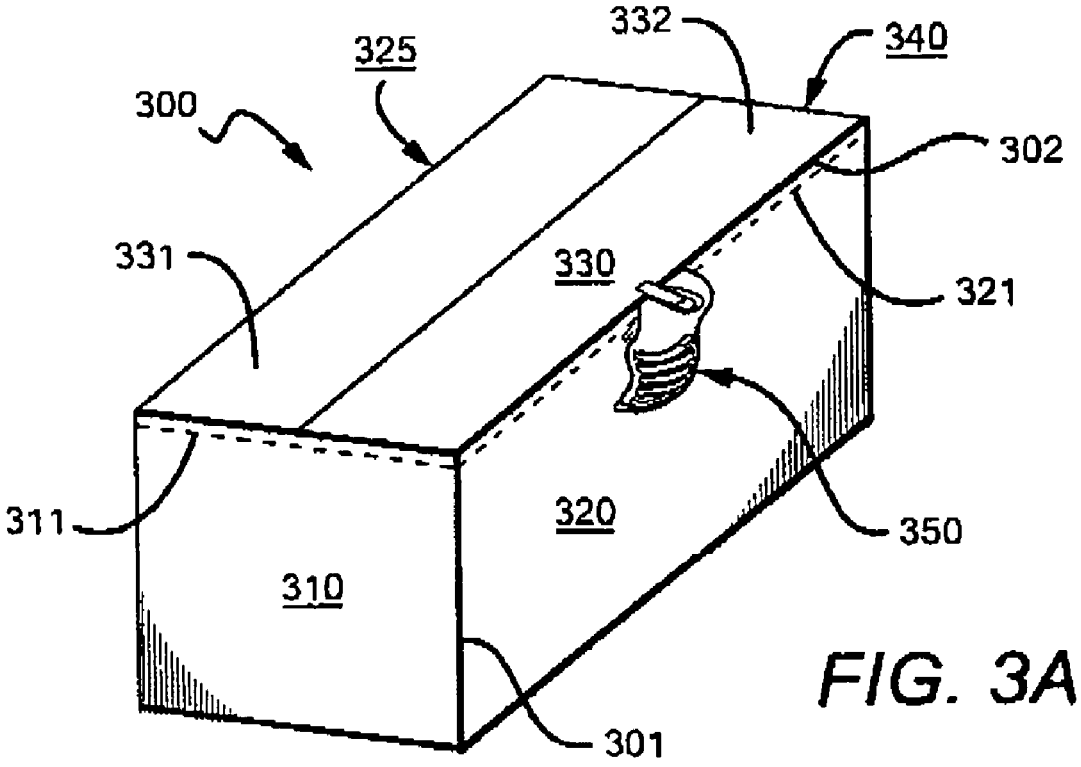
FIG. 3A is a perspective view of a 6 sided container.
Figure 3B:
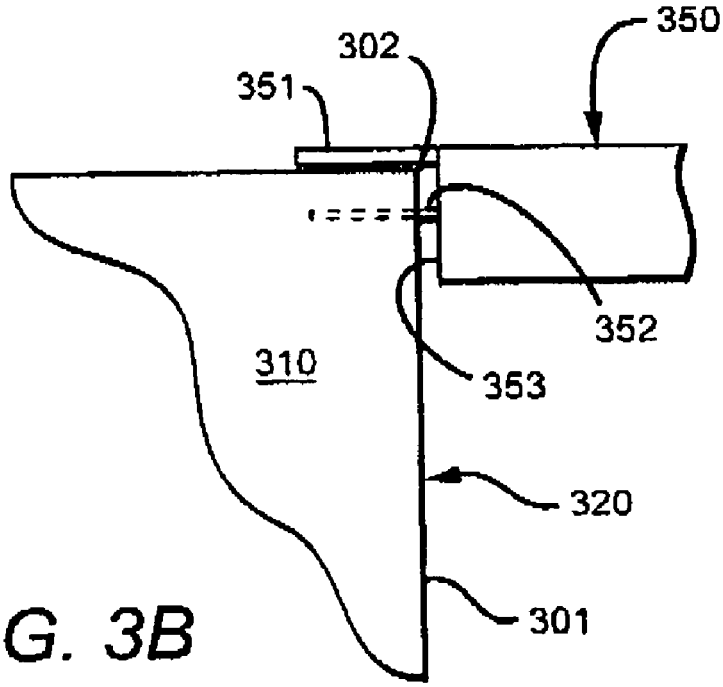
FIG. 3B is a detailed view of a knife having dual retractable cutting guides being used to remove one side of the container of FIG. 3A.

One application of knives such as knife 1 having dual retractable cutting guides is illustrated by FIGS. 3A and 3B. In FIG. 3A, a container 300 has six sides, five of which are sides 310, 320, 325, 330, and 340. Side 330 is at least partially formed by flaps 331 and 332, which are extensions of sides 320 and 340. Dotted lines 321 and 311 illustrate where cuts can be made to remove side 330 (assuming similar cuts are made on the opposite sides of container 300). Sides 310 and 320 are joined at corner/seam 301, and sides 320 and 330 at corner/seam 302. In FIG. 3B. a knife 350 having a blade 352 and cutting guides 351 and 353 is used to cut along imaginary line 321 on side 320 by retracting guide 353, extending guide 351, and cutting along side 320 while keeping guide 351 in contact with side 330 and/or corner/seam 302.

It is contemplated that knives having cutting guides as described herein may comprise any form of knife to which cutting guides may be attached. As such, the shapes, sizes, relative positions and orientations, and structure of the various components of such knives will likely vary between embodiments. As an example, knife bodies of different embodiments may comprise plastic, metal, or some other material or combination of materials. The actual components included or excluded from a particular knife embodiment will likely vary between embodiments as well. Thus certain embodiments may include less than all the elements shown herein, may include multiples of the elements shown herein, or may include elements in place of and/or in addition to elements shown herein.

It is contemplated that some embodiments may comprise more than two guides, or possibly may comprise two or more guides that are part of a single guide assembly.

A particularly contemplated use for the inventive knife is in cutting off the top of a box. In that usage one or the other of the cutting guides (depending on whether the user is right or left handed, and orientation of the box), would ride along the top edge of the box such that the cutting blade would cut the box just below the edge. Of course, similar cutting operations can be additionally or alternatively applied to the bottom and/or sides of a box.

Thus, specific embodiments and applications of tools, particularly cutting tools, with symmetrical cutting or other guides have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A knife comprising:

a portable, hand carried handle that holds a cutting blade;

left and right substantially parallel guide adaptations movably coupled to the handle such that the adaptations can be moved between, and fixed in, extended and retracted positions by a user; and a blade hood that is moveable with respect to the handle, and distinct from the guide adaptations.

2. The knife of claim 1 wherein the left guide adaptation includes a first edge guide, and the right guide adaptation simultaneously includes a second edge guide.

3. The knife of claim 2 wherein the first and second edge guides comprise distinct, non-connected pieces.

4. The knife of claim 2 wherein the left and right adaptations are each distanced from opposite sides of the blade by approximately the same distance.

5. The knife of claim 2 wherein the left and right adaptations are each distanced from opposite sides of the blade by less than 0.5 inches.

6. The knife of claim 2 wherein the left and right adaptations are each distanced from opposite sides of the blade by less than 0.25 inches.

7. The knife of claim 2 wherein at least one of the left and right adaptations is angled inwardly towards a bottom cutting surface of the blade at an angle of less than 10°.

8. The knife of claim 2 wherein at least one of the left and right adaptations is angled inwardly towards a bottom cutting surface of the blade at a positive angle of less than 6°.

9. The knife of claim 2 wherein at least one of the left and right adaptations includes a locking mechanism.

10. The knife of claim 2 wherein said blade hood is retractable.

11. The knife of claim 1 wherein the left guide adaptation is slidably disposed within a first slot portion of the handle.

12. The knife of claim 11 wherein the right guide adaptation is slidably disposed within a second slot portion of the handle, different from the first slot portion.

13. The knife of claim 1 wherein the edge guide adaptations are positioned such that they do not act as blade protectors.

* * * * *